US005921010A

United States Patent [19]

Schulte et al.

[11] Patent Number: 5,921,010

[45] Date of Patent: Jul. 13, 1999

[54] FLOW BLADE OPERATING SYSTEM

[75] Inventors: Raymond H. Schulte, Little Falls; Thomas Steinkamp, Excelsior, both of Minn.

[73] Assignee: Little Falls Machine, Inc., Little Falls, Minn.

[21] Appl. No.: 08/798,853

[22] Filed: Feb. 12, 1997

[51] Int. Cl.[6] ..... E01H 5/04

[52] U.S. Cl. ..... 37/232; 172/260.5; 172/265; 172/261

[58] Field of Search ..... 37/232, 234, 196; 172/794, 795, 261, 263, 264, 265, 260.5

[56] References Cited

U.S. PATENT DOCUMENTS 3,706,144 12/1972 Miceli .
3,893,518 7/1975 Farrell .
4,031,966 6/1977 Farrell .
4,074,448 2/1978 Niemela .
4,320,589 3/1982 Pelazza ..... 37/232
5,265,356 11/1993 Winter ..... 37/232
5,596,823 1/1997 Clasen et al. ..... 37/232
5,697,172 12/1997 Verseef ..... 37/232

*Primary Examiner*—Christopher J. Novosad
*Attorney, Agent, or Firm*—Nikolai, Mersereau & Dietz, P.A.

[57] ABSTRACT

A plow blade operating system having a plow or scraper is configured to quickly and retractably overcome obstacles that are encountered during plowing, scraping, and leveling activities without the need to recharge or reset the system pressure after the obstacles have been passed and which continually biases the plow or scraper downward against the road surface such that the plow or scraper will properly remove snow, sand, gravel, etc . . . from any dips or depressions in the road.

17 Claims, 4 Drawing Sheets

FLOW BLADE OPERATING SYSTEM

BACKGROUND OF THE INVENTION

I. Field of the Invention

The present invention relates generally to the field of plowing snow, scraping ice, leveling gravel, and the like. More particularly, the present invention relates to an improved plowing system wherein a scraper is configured to quickly and retractably overcome obstacles that are encountered during such plowing, scraping, and leveling activities without the need for recharging or resetting the system pressure after the obstacles have been passed and which continually biases the scraper downward against the road surface such that the scraper will properly remove snow, sand, gravel, etc . . . from any dips or depressions in the road.

II. Discussion of the Prior Art

In the field of plowing and removing materials such as snow, ice, gravel, and the like, manufacturers have for years worked towards producing scrapers which are responsive and easily retractable so that the scrapers do not suffer damage when obstructions are encountered during such activities. U.S. Pat. No. 3,706,144 to Miceli represents one such attempt, disclosing a snow plow equipped with a pair of hydraulic angling cylinders for controlling the orientation of the plow relative to the front of the vehicle, a hydraulic lifting cylinder for controlling the vertical elevation of the plow, and various valve arrangements for selectively controlling the amount of oil that is distributed to the angling cylinders and lifting cylinder. In an effort to minimize the amount of damage experienced by the plow during plowing activities, steel coil springs are provided extending between the top of the plow and a frame member for allowing the plow to yield when obstacles are encountered. Although generally effective in preventing plow damage, a drawback exists in that the steel coil springs are fully exposed to the elements. This may cause the coil springs to stick due to the accumulation of snow and ice around or within the coils, in addition to causing the coil springs to rust and/or corrode due to the continued exposure to harsh plowing conditions.

Another approach to reducing the damage experienced by scrapers during road clearing activities resides in U.S. Pat. No. 3,893,518 to Farrell. In this patent, a plowing system is disclosed having a hydraulic cylinder and control system for selectively moving the plow between a raised position to a road contacting position. The system is charged at the onset of operations such that the hydraulic cylinder biases the plow into contact with the road surface. The hydraulic cylinder is further equipped with internally disposed spring means for automatically tripping the plow away from the road surface when the plow hits an obstruction and for automatically returning the plow into contact with the road surface when the obstruction is passed. While this arrangement obviates the problems attendant with the exposed spring members found in U.S. Pat. No. 3,706,144 to Miceli, a problem nonetheless exists in terms of the ability of the plowing system to accommodate immovable obstacles encountered while plowing. To be more specific, a pressure relief valve is employed which routes hydraulic fluid back into the reservoir when overpressure conditions exists or, in other words when the pressure within the hydraulic circuit exceeds a predetermined threshold. Such overpressure conditions exist when the plow hits an immovable object because the rearward motion of the plow causes a piston member within the hydraulic cylinder to displace and thereby forces hydraulic fluid out of the cylinder. Once the obstacle has been passed, the system operator must thereafter manually recharge the hydraulic cylinder to its predetermined pressure setting such that the plow returns to its originally biased state against the road surface. As will be readily appreciated, this need for manual operation is disadvantageously time consuming and furthermore may introduce inconsistency in the degree to which the plow is biased against the road surface.

U.S. Pat. No. 4,031,966 to Farrell represents yet another attempt at equipping a plow or scraper so as to yield to obstructions encountered while plowing. In this arrangement, a pair of cylinders operate with pressurized fluid and air to selectively move the plow between a raised position and a road contacting position, in addition to permitting the plow to yield when it engages a fixed obstacle in the road and return to the road contacting position when the obstacle has passed. The cylinders are first charged with pressurized air after which one of the cylinders is charged with pressurized hydraulic fluid. The hydraulic charge forces all of the air into the other cylinder and further compresses the air therewithin such that the compressed air biases the plow into contact with the road surface. While this approach is effective in alleviating the need for mechanical spring members, several formidable drawbacks still remain in the '966 patent which leave the field of endeavor in want of an improved plowing system.

One of the more pronounced defects in the '966 approach stems from the use of pressurized air in combination with pressurized hydraulic oil. To be more specific, this system is extremely dangerous in that it runs the risk of causing diesel combustion, which can result when air is charged to pressures above 200 p.s.i. and subsequently combined with hydraulic oil. This condition is a distinct possibility in that the step of charging the system with hydraulic oil further compresses the charged air from an initial level of 115 p.s.i. to a final level of approximately 575 p.s.i. As such, pressurized hydraulic fluid may leak or seep past the pistons into contact with the compressed air, thus raising the specter of diesel combustion. The potential for seal leakage is especially profound after prolonged periods of use when piston seals can become weakened and/or damaged. A further disadvantage resides in the fact that the system must be recharged prior to each individual plowing activity. As will be explained below, this results in increased response times for the operator to calibrate the system, in addition to cylinder damage over time. By way of background, each time a truck employing the plowing system of the '966 patent is started up the operator must manually open up an air valve to re-route compressed air from truck's air supply into the cylinders to charge the cylinders to approximately 115 p.s.i. This charging step serves to move the plow downwardly into engagement with the surface of the road and requires the operator to carefully control and monitor the degree to which air is introduced into the cylinder so that an air pressure of 115 p.s.i. is attained therewithin. Thereafter, the operator must manually operate the hydraulic valve manifold to charge the cylinders with hydraulic oil until the compressed air is further pressurized to approximately 575 p.s.i. Thus, the system of the '966 reference is disadvantageously time consuming in that each of the foregoing steps must be manually undertaken by the operator each time the truck is started in order to properly calibrate the system.

The '966 system is also flawed in that cylinder damage may result over time due to the attendant hydraulic foaming which tends to occur when the hydraulic oil is pumped from the reservoir. To be more specific, air bubbles are introduced into the hydraulic oil as the hydraulic oil is being pumped from the reservoir. These air bubbles are then transported within the hydraulic oil and introduced into the cylinders at great speeds, thereby resulting in intermittent rushes of oil and air which can be extremely harsh and damaging to the cylinders. In that cylinders are typically constructed from brass, which is relatively soft, the problem of hydraulic foaming is particularly ominous to the useful life of the system disclosed in the '966 patent, which, as noted above, requires recharging each time the truck is to be used for plowing.

Still another drawback of the '966 patent stems from the use of a 1500 p.s.i. pressure relief valve in between the pump and the hydraulic valve manifold. To further explain, trucks engaged in plowing activities are commonly equipped with several hydraulic implements, such as plows, hoists, underbody scrapers, and sanders, all of which are operated through the use of a single hydraulic circuit disposed within the truck. With the pressure relief valve disposed in between the pump and the valve manifold as disclosed, the maximum hydraulic pressure capable of being supplied to the various implements associated with the truck is limited to 1500 p.s.i. However, implements such as hoists and sanders typically require hydraulic pressures ranging between 2,000 p.s.i. to 3,000 p.s.i. for proper operation. With the hydraulic circuit limited to 1500 p.s.i., therefore, the device of the '966 patent is incapable of supplying adequate hydraulic pressure to these implements which require higher operating pressures, thereby curtailing the overall effectiveness of the truck. U.S. Pat. No. 4,074,448 to Niemela represents still another prior art plowing arrangement having the ability to avoid obstructions. The plow device of this reference boasts a dual construction with a vertically disposed hinge member joining a pair of blade sections, wherein the entire plow device is capable of yielding vertically away from the road surface upon hitting an obstruction and each individual blade section is capable of yielding horizontally rearward toward the truck upon hitting an obstruction. The ability to yield in the vertical plane is due to a horizontally disposed hinge unit which allows the plow to rotate about the horizontal hinge out of contact with the surface of the road when an obstacle is encountered. A spring-operated or pneumatically-operated biasing cylinder may be further provided to assist in returning the plow into contact with the road surface once the obstruction has been overcome. In order for the plow to yield in the horizontal plane, each blade section is equipped with either a bi-directional hydraulic cylinder, which is capable of both retracting and extending the individual blade sections, or a unidirectional hydraulic cylinder in combination with a biasing spring, which are used to retract and extend the blade sections, respectively. As with the previously discussed prior art plowing arrangements, a multitude of significant drawbacks similarly exist with the plowing device of the '448 reference.

With initial attention being directed to the vertical yielding feature of the '448 reference, the arrangement as disclosed is flawed in that it is possible for debris to become lodged between the opposing plates of the horizontal hinge member when obstructions are encountered. This stems from the fact that the opposing plates which comprise the horizontal hinge become separated when the plow encounters an obstruction while plowing. During the time that the horizontal hinge is in this separated condition, rocks and/or portions of ice and snow may be introduced between the opposing plates, thereby prohibiting the plates of the horizontal hinge from returning into flush contact with one another when the obstruction has been passed. This, in turn, may cause the plow to remain in an undesirable angled position or, worse yet, it may actually prohibit the plow from returning to the road surface even after the obstruction has been passed. Related problems may also result in terms of halting the plowing activities to clear the unwanted debris from within the compressed position between the plates of the horizontal hinge, which may be time consuming as well as dangerous.

Turning now to the horizontal yielding feature of the '448 device, this is also flawed due to the hydraulic system used to control each of the hydraulic cylinders which bias the blade sections in the extended position. To be more specific, a pressure relief valve is provided between the pump and each hydraulic cylinder (uni-directional or bidirectional) used to maintain the blade sections in the normal plowing position. Pressure relief valves are common in the art and basically serve as a safeguard to discharge hydraulic fluid from the pressure line back into the fluid reservoir during an overpressure condition within the pressure line. By positioning the pressure relief valve in between the pump and each hydraulic cylinder used to operate the blade sections, hydraulic fluid may be dumped back into the fluid reservoir when the blade sections yield rearwards upon encountering an immovable obstacle in the road surface. While the use of pressure relief valves in this fashion is effective in regulating overpressure conditions within the fluid lines which supply these hydraulic cylinders, a disadvantage exists in that the fluid pressure within the cylinders must be reset after each instance that the hydraulic fluid is forced back into the reservoir. As will be appreciated, the task of resetting or recharging the fluid pressure within the cylinders is time consuming in that the operator must manually operate a valve manifold to direct oil under pressure into the cylinders to return the cylinders to their normal operating pressure.

Based on the foregoing, it is apparent that a need exists for an improved plowing system which solves the aforementioned deficiencies in the prior art. Namely, a need exists for an improved plowing system which allows the plow or scraper to quickly and retractably overcome any obstacles that are encountered during plowing activities and which continually biases the scraper downward against the road surface such that the scraper will properly remove snow, sand, gravel, etc . . . from any dips or depressions in the road. Moreover, the improved plowing system should advantageously eliminate the need to recharge and recalibrate the hydraulic pressure within the system each time plowing operations are initiated, thereby decreasing the time required to prepare the truck for operation and decreasing the likelihood of cylinder damage. The improved plowing system should furthermore eliminate the potential for diesel combustion, in addition to providing the ability to simultaneously operate a plurality of hydraulic implements at a variety of different operating pressures. Additionally, the improved plowing system should allow the plow to yield upon hitting an obstacle without presenting the possibility that unwanted debris will prohibit the plow from returning to the proper position against the road surface.

SUMMARY OF THE INVENTION

It is accordingly a principal object of the present invention to provide an improved plowing system which allows the scraper to quickly and retractably overcome any obstacles that are encountered during plowing activities without having to recharge the system after the obstacle has been passed and which continually biases the scraper downward against the road surface such that the scraper will properly remove snow, sand, gravel, etc . . . from any dips or depressions in the road.

It is a further object of the present invention to provide an improved plowing system which does not need to recharge and recalibrate the hydraulic pressure within the system each time plowing operations are initiated, thereby decreasing the time required to prepare the truck for operation and decreasing the likelihood of cylinder damage.

It is another object of the present invention to provide an improved plowing system that is safe to use and eliminates the potential for diesel combustion.

It is yet another object of the present invention to provide an improved plowing system which does not limit or restrict the overall hydraulic pressure within the system such that a plurality of hydraulic implements may be simultaneously operated at a variety of different operating pressures.

It is still another object of the present invention to provide an improved plowing system which enables the scraper to yield upon hitting an obstacle without presenting the possibility that unwanted debris will prohibit the scraper from returning to the proper position against the road surface.

In accordance with a broad aspect of the present invention, the aforementioned objects are realized by providing an improved plowing system comprising plow means, an actuating cylinder coupled between a motor vehicle and the plow means, and control means for selectively maneuvering the plow means into a retractably engaged position against a road surface. The plow means is hingedly coupled to the motor vehicle. The actuating cylinder has a generally cylindrical housing member coupled to the motor vehicle, a slidable piston member disposed within the cylindrical housing member defining a first actuating chamber and a second actuating chamber, and an elongated rod member extending between the piston member and the plow means. The control means is coupled to the actuating cylinder and includes fluid delivery means, pressure modulation means, and overpressure absorbtion means. The fluid delivery means is communicatively coupled to the pressure modulation means for selectively delivering hydraulic fluid under pressure to the pressure modulation means. The pressure modulation means is communicatively coupled to the first actuating chamber and cooperatively operable with the overpressure absorbtion means for charging the first actuating chamber to a predetermined biasing pressure such that the piston member forces the plow means against the road surface at a predetermined downforce. The overpressure absorbtion means is capable of temporarily absorbing overpressure conditions within the first actuating chamber due to the plow means momentarily retracting from the road surface upon encountering an obstacle and thereafter returning the plow means to the road surface when the obstacle has been passed. The pressure modulation means is further characterized as preventing the loss of hydraulic fluid within a biasing circuit during the overpressure conditions, the biasing circuit including the first actuating chamber and a conduit member extending between the first actuating chamber and the pressure modulation means.

In accordance with another broad aspect of the present invention, the foregoing objects are acheived by providing an apparatus for biasing a vehicle-mounted plow against a road surface at a predetermined bias level such that said plow can retractably overcome obstacles encountered while plowing and thereafter return to said predetermined bias level against the road surface, comprising actuating means coupled between the vehicle and the plow for selectively positioning the plow relative to the road surface and means for controlling the actuating means. The actuating means includes a housing member, a piston member dimensioned to be slideable within the housing member to define a first actuating chamber and a second actuating chamber, and an elongated rigid member externing between the piston member and the plow. The means for controlling the actuating means includes fluid delivery means for delivering hydraulic fluid under pressure, pressure modulation means communicatively coupled to the hydraulic fluid delivery means, and overpressure absorbtion means coupled to the actuating means. The pressure modulation means is cooperatively operable with the overpressure absorbtion means to generate a predetermined hydraulic biasing pressure within a biasing circuit comprising the first actuating chamber and a conduit member extending between the first actuating chamber and the pressure modulation means to thereby retractably bias the plow against the road surface at the predetermined bias level. The overpressure absorbtion means is capable of temporarily absorbing overpressure conditions within the biasing circuit due to the plow hitting an obstacle while plowing. The pressure modulation means is capable of preventing the escape of hydraulic fluid from within the biasing circuit during the overpressure conditions.

In still a further broad aspect of the present invention, a method for retractably biasing a vehicle-mounted scraper to a road surface is provided, comprising the steps of: (a) coupling an actuator between the scraper and a motor vehicle wherein the actuator includes a cylindrical housing member, a slideably displaceable piston member defining a first actuating chamber and a second actuating chamber within the housing member, and a rigid connecting member extending between the piston member and the scraper; (b) selectively charging a biasing circuit to a predetermined hydraulic biasing pressure to engage the scraper against the road surface at a predetermined downforce; (c) temporarily absorbing overpressure conditions within the first actuating chamber when the scraper hits an obstacle while scraping such that the scraper may temporarily retract from the road surface and thereafter return to the road surface once the obstacle has been passed; and (d) preventing the escape of hydraulic fluid from within the biasing circuit when the overpressure conditions develop within the biasing circuit due to the scraper hitting an obstacle while scraping.

The foregoing features and advantages of the present invention will be readily apparent to those skilled in the art from a review of the following detailed description of the preferred embodiment in conjunction with the accompanying drawings and claims.

DETAILED DESCRIPTION OF THE PREFERRED EMBODIMENT

Figure 1:
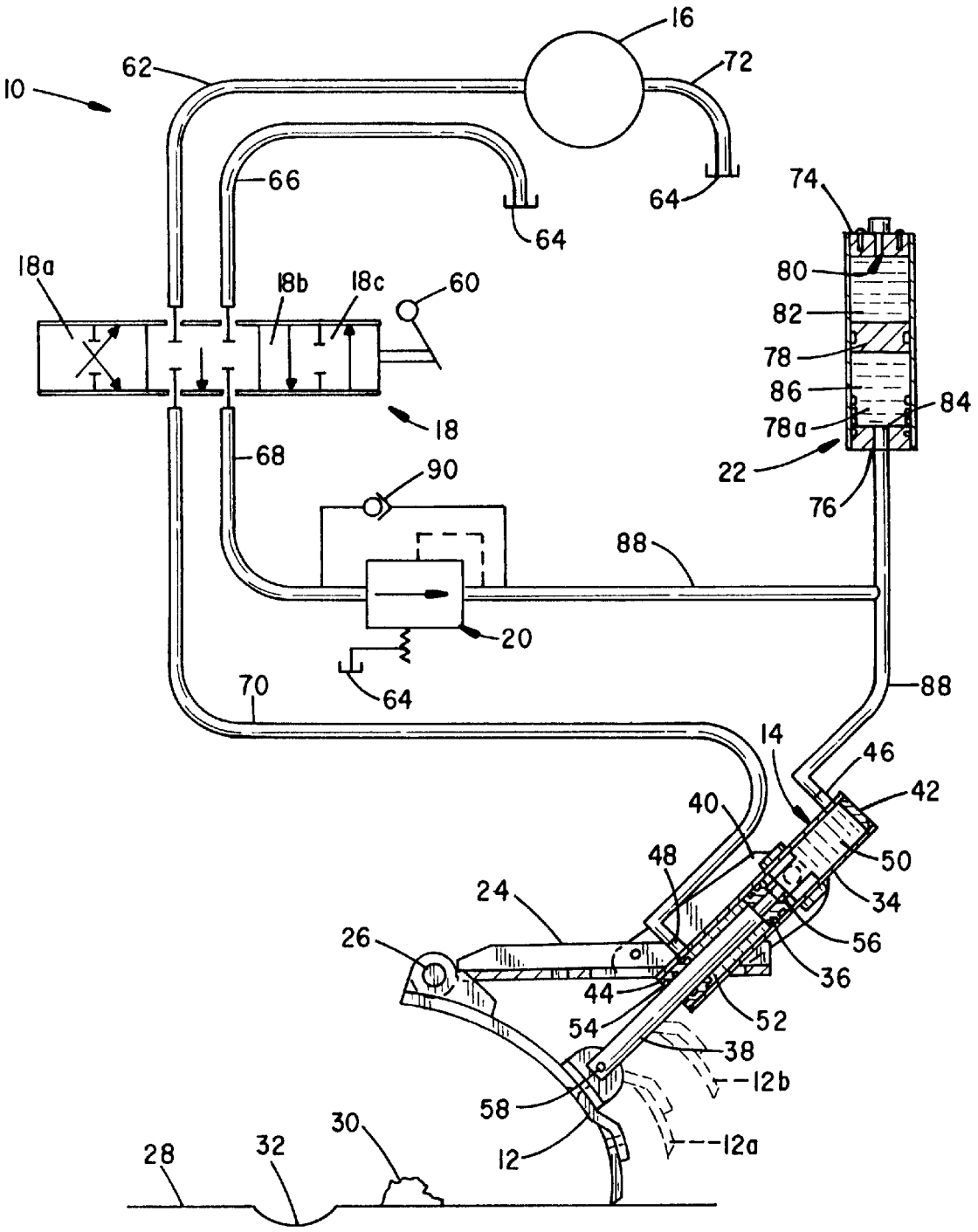
FIG. 1 is a schematic diagram of a first preferred embodiment of the improved plowing system of the present invention.

FIG. 1 illustrates an improved plowing system 10 constructed in accordance with a first preferred embodiment of the present invention. The improved plowing system 10 includes an underchassis scraper or plow 12, an actuating cylinder 14, and a hydraulic control circuit comprising an hydraulic pump 16, a control valve 18, a pressure reducing valve 20, and an accumulator 22. The scraper 12 is pivotally connected to a strut member 24 fixed beneath the chassis of the motor vehicle (not shown) via a coupling pin 26 such that the scraper 12 is positioned in the general proximity of a road surface 28. As will be explained in detail below, the control circuit cooperates with the actuating cylinder 14 to selectively maneuver the scraper 12 between a road contacting position (shown in solid lines) a partially retracted position (as shown in dashed lines at 12*a*) and a fully retracted position (shown in dashed lines at 12*b*). When disposed in the road-contacting position, the control circuit biases the scraper 12 against the road surface 28 such that the scraper 12 can quickly and retractably overcome obstructions, such as at 30, to avoid scraper damage and effectively follow the contour of any dips or depressions, such as at 32, to properly remove gravel, sand, snow, ice, etc . . . therefrom. In an important aspect of the present invention, the control circuit maintains a predetermined biasing pressure within a biasing circuit when disposed in the road contacting position during normal scraping activities, i.e. where no obstacles cause the scraper 12 to temporarily disengage, and moreover prevents the loss of hydraulic fluid from the biasing circuit during overpressure conditions which result when the scraper 12 temporarily disengages due to an immovable obstacle. By preventing the loss of hydraulic fluid during overpressure conditions, the control circuit advantageously eliminates the need to recharge or reset the hydraulic pressure within the biasing circuit after the obstructions have been passed, thus providing an improved plowing system capable of being operated for long periods of time with low operator maintenance requirements.

The actuating cylinder 14 includes a cylindrical housing member 34, a piston member 36, and an elongated rod member 38. The housing member 34 is coupled to a support plate 40 on the motor vehicle (not shown) and includes a first end cap 42, a second end cap 44, a first port 46 proximate the first end cap 42, and a second port 48 proximate the second end cap 44. The piston member 36 is slidably disposed within the housing member 34 so as to form a first actuating chamber 50 between the first end cap 42 and the piston member 36 and a second actuating chamber 52 between the second end cap 44 and the piston member 36. The elongated rod member 38 extends through an aperture 54 formed in the second end cap 44 and is fixedly attached to the piston member 36 via a nut member 56 and pivotally attached to the scraper 12 via a connecting pin 58. Although not shown in detail, an O-ring is provided within the aperture 54 to prevent hydraulic fluid from leaking out of the second actuating chamber 52 as the rod member 38 extends through the aperture 54. As will be appreciated by those skilled in the art, the selective introduction and withdrawal of hydraulic fluid into and out of the first and second actuating chambers 50, 52 forces the piston member 36 to move back and forth within the housing member 34 of the actuating cylinder 14. In that the piston member 36 is connected to the scraper 12 via the rod member 38, the movement of the piston member 36 translates directly to the scraper 12. As such, the position of the scraper 12 relative to the road surface 28 is dictated by the position of the piston member 36 within the actuating cylinder 14.

Generally speaking, the control valve 18 is provided for selectively directing hydraulic fluid under pressure into either of the first and second actuating chambers 50, 52 for the purposes of engaging and disengaging the scraper 12 from the road surface 28. In a preferred embodiment, the control valve 18 is a three position hydraulic control valve having a handle member 60 which allows an operator to select between a scraper-lowering mode at 18*a*, a closed mode at 18*b*, and a scraper-raising mode at 18*c*. The control valve 18 is coupled to the hydraulic pump 16 via a conduit 62, a fluid reservoir 64 via a conduit 66, the pressure reducing valve 20 via a conduit 68, and the second actuating chamber 52 via a conduit 70. The hydraulic pump 16 is further coupled to the hydraulic fluid reservoir 64 via a conduit 72 and configured to draw hydraulic fluid from the fluid reservoir 64 for pressurized delivery to the control valve 18. When disposed in the scraper-lowering mode at 18*a*, the control valve 18 establishes a line of fluid communication between the conduit 62 and the conduit 68 such that the pressurized hydraulic fluid from the hydraulic pump 16 flows directly to the pressure reducing valve 20 for subsequently charging the first actuating chamber 50. A line of fluid communication is also simultaneously formed between the conduit 66 and the conduit 70 such that any hydraulic fluid disposed within the second actuating chamber 52 may return to the fluid reservoir 64 during the charging of the first actuating chamber 50. When disposed in the scraper-raising mode at 18*c*, the control valve 18 establishes a line of fluid communication between the conduit 62 and the conduit 70 such that the pressurized hydraulic fluid from the pump 16 is directed into the second actuating chamber 52 for moving the piston member 36 towards the first end cap 42. A line of fluid communication is also simultaneously formed between the conduit 66 and the conduit 68 such that the hydraulic fluid within the first actuating chamber 50 may be return to the fluid reservoir 64 during the charging of the second actuating chamber 52. In a preferred embodiment, the control valve 18 is disposed in the passenger area of the motor vehicle (not shown) such that an operator may easily access and manipulate the handle member 60 to quickly choose between the scraper-engaging mode 18*a*, the closed mode 18*b*, and the scraper-disengaging mode at 18*c*.

The accumulator 22 includes a generally hollow and cylindrical housing member 73, a first end cap 74, a second end cap 76, and an internally disposed and slidably displaceable piston member 78. The first end cap 74 has a port 80 formed therethrough for providing access to a first accumulator chamber 82 defined between the first end cap 74 and the piston member 78. In similar fashion, the second end cap 76 has a port 84 formed therethrough for providing access to a second accumulator chamber 86 defined between the second end cap 76 and the piston member 78. The piston member 78 is slidably displaceable within the housing member 73 of the accumulator 22 such that the volume of the first and second accumulator chambers 82, 86 changes as the piston member 78 is caused to move back and forth within the housing member 73. In an important aspect of the present invention, the accumulator 22 is precharged at the time of manufacture by injecting nitrogen gas into the port 80 formed within the first end cap 74 such that the pressure of the nitrogen within the first accumulator chamber 82 is maintained at approximately 375 p.s.i. In that the accumulator 22 is manufactured as a separate and distinct component from the rest of the control circuit, the pressurized nitrogen forces the piston member 78 into the generally flush position against the second end cap 76 illustrated in phantom at 78*a*. As will be explained in greater detail below, precharging the accumulator 22 in this fashion is particularly advantageous in that it greatly simplifies the task of positioning the scraper 12 into contact with the road surface 28 at a predetermined and consistent downforce.

The pressure reducing valve 20 is coupled to the second accumulator chamber 86 and the first actuating chamber 50 via a conduit 88. In an important aspect of the present invention, when the control valve 18 is disposed in the scraper-engaging mode 18*a*, the pressure reducing valve 20 permits hydraulic fluid to flow into a biasing circuit comprising the conduit 88, the first actuating chamber 50, and the second accumulator chamber 86 until the pressure therewithin plateaus at a predetermined hydraulic biasing pressure for engaging the scraper 12 against the road surface 28 at a predetermined downforce. In a preferred embodiment, the pressure reducing valve 20 cooperates with the accumulator 22 such that the predetermined biasing pressure within the biasing circuit is approximately 500 p.s.i. In an important aspect of the present invention, the pressure reducing valve 20 only permits hydraulic fluid to flow in a unidirectional fashion into the biasing circuit during the scraper-lowering mode at 18*a* such that the hydraulic fluid within the biasing circuit is incapable of escaping or re-routing back to the fluid reservoir 64 when overpressure conditions develop therewithin. In this fashion, the improved plowing system of the present invention to quickly and retractably overcome obstructions encountered while plowing without the need for recharging or resetting the system pressure after the obstructions have been passed, in addition to continually biasing the scraper 12 downward against the road surface 28 such that the scraper 12 will follow the contour of any dips or depressions in the road surface 28. In a preferred embodiment, the pressure reducing valve 20 is further equipped with a parallelly disposed and selectively openable one-way check valve 90 for allowing the fluid within the biasing circuit to return to discharge to the fluid reservoir when the control valve 18 is set to the scraper-raising mode at 18*c*.

The operation of the improved plowing system 10 will now be set forth in detail. In order to engage in plowing, scraping, and/or leveling activities, the scraper 12 must first be lowered into the road contacting position shown in solid lines, which is accomplished by setting the handle member 60 of the control valve 18 into the scraper-engaging mode shown at 18*a*. As illustrated schematically by the arrows, the scraper-engaging mode shown at 18*a* causes a flow of hydraulic fluid under pressure to be directed into the conduit 68, through the pressure reducing valve 20, and into the conduit 88. As the hydraulic fluid is progressively directed into the conduit 88, the hydraulic pressure within the first actuating chamber 50 increases and progressively forces the piston member 36 away from the first end cap 42 so as to bring the scraper 12 into contact with the road surface 28. At this point, the piston member 78 within the accumulator 22 is still positioned as shown in phantom at 78*a* in that the pressure within the first accumulator chamber (375 p.s.i.) exceeds the pressure within the first actuating chamber 50 when the scraper 12 is initially forced into contact with the road surface 28. However, as the pump 16 continues to supply hydraulic fluid under pressure into the conduit 88, the pressure within the first actuating chamber 50 will progressively raise until it exceeds 375 p.s.i., after which point the piston member 78 within the accumulator 22 will remove from the flush position shown at 78*a* and slidably displace towards the first end cap 74 as the pressure within the biasing circuit raises above 375 p.s.i. As noted above, the pressure reducing valve 20 permits the pressure within the biasing circuit (including the first actuating chamber 50, the second accumulator chamber 86, and the conduit 88) to raise to 500 p.s.i., after which point it restricts the incoming hydraulic fluid within the biasing circuit to a maximum of 500 p.s.i. In a preferred embodiment, the piston member 78 within the accumulator 22 will be disposed in the middle of the housing member 73 as shown in solid lines when the pressure within the first actuating chamber 50 is approximately 500 p.s.i.

With the hydraulic control circuit of the present invention fully charged as described above, the scraper 12 is advantageously capable of yielding when an obstruction, such as at 30, is encountered while engaging in plowing, scraping, and/or leveling activities. To be more specific, the scraper 12 will displace rearwards upon hitting an obstruction such that the rod member 38 is driven rearwards into the housing member 34. This, in turn, forces the piston member 38 towards the first end cap 42, thereby causing the hydraulic fluid disposed within the first actuating chamber 50 to flow back into the conduit 88. In that the pressure reducing valve 20 will not permit the resulting overpressure to release back to the fluid reservoir 64, the piston member 78 within the accumulator 22 is forced into motion towards the first end cap 74 to compress the nitrogen disposed within the first accumulator chamber 82. By providing the ability to absorb the overpressure within the first accumulator chamber 82, the present invention advantageously allows the scraper 12 to temporarily yield and thus avoid damage that would otherwise result from hitting obstructions while plowing. Moreover, the compressed nitrogen within the first accumulator chamber 82 forces the piston member 36 within the actuating cylinder 14 back towards the second end cap 44 when the obstruction has been passed so as to quickly return the scraper 12 from the partially retracted position shown at 12*b* into the road contacting position. In so doing, the improved plowing system of the present invention does not reduce the total amount of hydraulic fluid within the biasing circuit, i.e. the conduit 88, first actuating chamber 50, and the second accumulator chamber 86 when overpressure conditions develop therewithin due to hitting obstructions with the scraper 12. Instead, the resulting overpressure is absorbed totally by the accumulator 22. As such, the present invention advantageously overcomes the prior art plowing systems which respond to overpressure conditions by reducing the amount of hydraulic fluid within the system and thereafter require the system pressure to be manually recharged.

In addition to the foregoing features, the improved plowing system of the present invention also continually biases the scraper 12 downward against the road surface 28 such that the scraper 12 will follow the contour of any dips or depressions in the road surface, such as at 32. In so doing, the present invention is capable of removing snow, gravel, sand, ice, etc. . . from any such dips 32 during plowing, scraping, and or leveling activities so as to provide for a high quality removal of such debris. The present invention is capable of responding to dips 32 in this fashion due to the fact that the nitrogen within the first accumulator chamber 82 is compressed from the initial pressure of 375 p.s.i. to the final pressure of 500 p.s.i. This, as noted above, is accomplished by charging the hydraulic fluid within the biasing circuit (conduit 88, first actuating chamber 50, and second accumulator chamber 86) to 500 p.s.i. which consequently forces the piston member 78 of the accumulator 22 into the equilibrium point in the middle of the housing member 73 as shown in solid lines. As such, the nitrogen is compressed an additional 125 p.s.i. above the original precharged state of 375 p.s.i. such that, when a dip or depression 32 is encountered in the road surface 28, the collective pressure (500 p.s.i.) of the compressed nitrogen within the first accumulator chamber 82 and the hydraulic fluid within the conduit 88 and the first actuating chamber 50 forces the piston member 36 within the actuating cylinder 14 downward towards the second end cap 44 such that the rod member 38 drives the scraper 12 into the dip 32. As the scraper 12 passes the dip 32, the rod member 38 is forced back towards the first end cap 42 to return the piston member 78 to the equilibrium position within the housing member 73 as shown in solid lines.

The scraper 12 may be raised into the retracted position shown at 12*b* by manipulating the handle member 60 such that the control valve 18 is set to the scraper-disengaging mode at 18*c*. In this mode, a line of fluid communication is established between the conduit 66 and the conduit 70 such that pressurized hydraulic fluid from the pump 16 may be driven into the second actuating chamber 52. The selectively openable check valve 90 is also opened so as to establish a by-pass around the pressure reducing valve 20. Establishing this by-pass provides an outlet for the pressure hydraulic fluid that was previously trapped within the biasing circuit or, in other words, the conduit 88, the second accumulator chamber 86, and the first actuating chamber 50. To be more specific, the pressure of this hydraulic fluid causes it to flow back to the fluid reservoir 64 via the conduit 66 and the conduit 68 until the pressure therewithin drops to approximately 0 p.s.i. The first action to take place during such pressure equalization is the movement of the piston member 78 of the accumulator 22 back to the flush position against the second end cap 76 as shown in phantom at 78*a*. This, once again, is due to the fact that the first accumulator chamber 82 is precharged to 375 p.s.i. at the time of manufacture. After the piston member 78 of the accumulator 22 returns to its original position at 78*a*, the pressure within the conduit 88 and the first actuating chamber 50 subsequently drops to a fully discharged pressure of approximately 0 p.s.i. At this point, the scraper 12 may be raised to the retracted position shown at 12*b* by supplying hydraulic fluid into the second actuating chamber 52 via the conduit 70 until the hydraulic pressure within the second actuating chamber 52 increases to the point that the piston member 36 is forced into motion toward the first end cap 42, thereby raising the scraper 12 from the road surface 28 into the retracted position.

Figure 2:
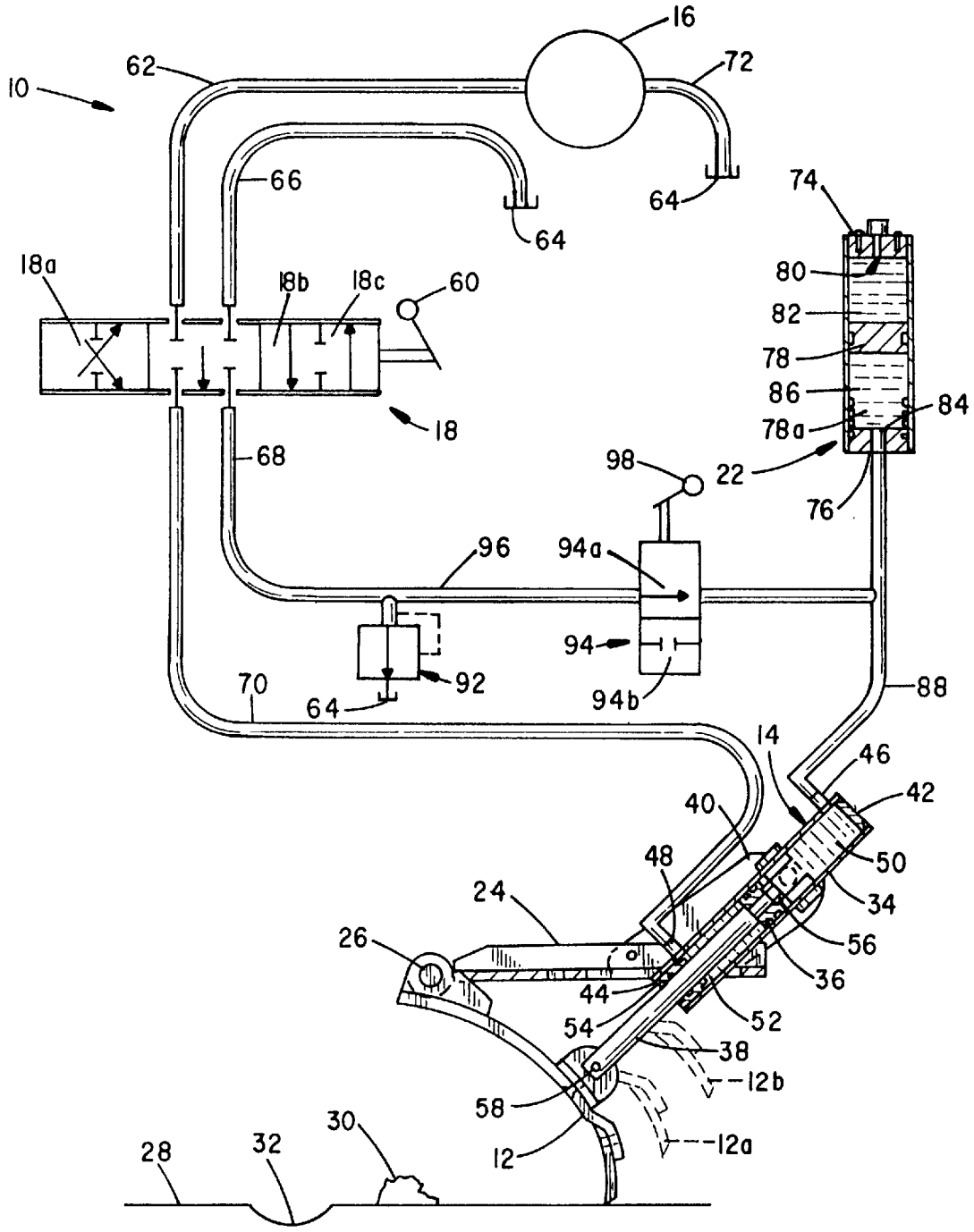
FIG. 2 is a schematic diagram of a second preferred embodiment of the improved plowing system of the present invention.

FIG. 2 illustrates the improved plowing system 10 constructed in accordance with a second preferred embodiment of the present invention. The main difference between this embodiment and that shown in FIG. 1 is that the pressure reducing valve 20 of FIG. 1 has been replaced with an alternate valving arrangement comprising a pressure relieving valve 92 and a selectively operable shut-off valve 94. Other than the substitution of the pressure reducing valve 20 and the elimination of the one-way check valve 90, all other components of the improved plowing system 10 are identical in construction as that described in FIG. 1 and, consequently, a description of these components need not be repeated. In an important aspect, the pressure relief valve 92 and shut-off valve 94 are collectively capable of functioning in a manner identical to the pressure reducing valve 20 of FIG. 1. To further explain, the pressure relief valve 92 is coupled to the control valve 18 via the conduit 68 and to the shut-off valve 94 via a conduit 96, while the shut-off valve 94 is further coupled to the conduit 88. When the control valve 18 is initially moved to the scraper-lowering mode 18*a*, the shut-off valve 94 is initially set to the open position shown at 94*a* in order to establish fluid communication between conduits 88, 96. During this period, the pressure relief valve 92 permits a one-way flow of pressurized hydraulic fluid into the biasing circuit (the first actuating chamber 50, the second accumulator chamber 86, and the conduit 88) until the pressure therewithin raises to the predetermined biasing pressure of 500 p.s.i. However, unlike the pressure reducing valve 20 of FIG. 1, the pressure relief valve 92 is configured to re-route hydraulic fluid from within the biasing circuit back to the fluid reservoir 64 when overpressure conditions develop therewithin. To combat the overpressure re-routing function of the pressure relief valve 92, the shut-off valve 94 is advantageously provided for locking the hydraulic fluid within the biasing circuit once the predetermined hydraulic biasing pressure has been attained within the biasing circuit. In the preferred embodiment shown, the shut-off valve 94 is manually operable such that an operator may selectively close off the biasing circuit by positioning the handle member 98 to the closed mode at 94*b* after the predetermined biasing pressure has accrued within the biasing circuit. When the control valve 18 is disposed in the scraper-raising mode 18*c*, the shut-off valve 94 is re-opened such that the hydraulic fluid within the biasing circuit may flow back into the fluid reservoir 64.

Through the foregoing arrangement, the improved plowing system 10 is capable of performing in the same fashion as the embodiment of FIG. 1 so as to temporarily absorb overpressure conditions which result from hitting obstacles while the scraper 12 is in the road-contacting position. More specifically, the nitrogen within the first accumulator chamber 82 is capable of compressing when overpressure conditions develop within the biasing circuit such that the scraper 12 may temporarily retract from the engaged position and thereby overcome the immovable obstructions causing the overpressure condition. After the obstruction has been passed, the compressed nitrogen within the first accumulator chamber 82 forces the piston member 78 back towards the second end cap 76 so as to quickly return the scraper 12 from the partially retracted position shown at 12*b* into the road contacting position. This effectively minimizes the amount of scraper damage over time which, consequently, translates into lower expenditures for refurbishing and/or repairing the scraper 12. Moreover, the improved plowing system 10 does not reduce the total amount of hydraulic fluid within the biasing circuit (the conduit 88, first actuating chamber 50, and the second accumulator chamber 86) when overpressure conditions develop therewithin due to hitting obstructions with the scraper 12. As noted above, this is a distinct advantage over the prior art plowing systems which respond to overpressure conditions by reducing the amount of hydraulic fluid within the system and thereafter require hydraulic recharging.

Figure 3:
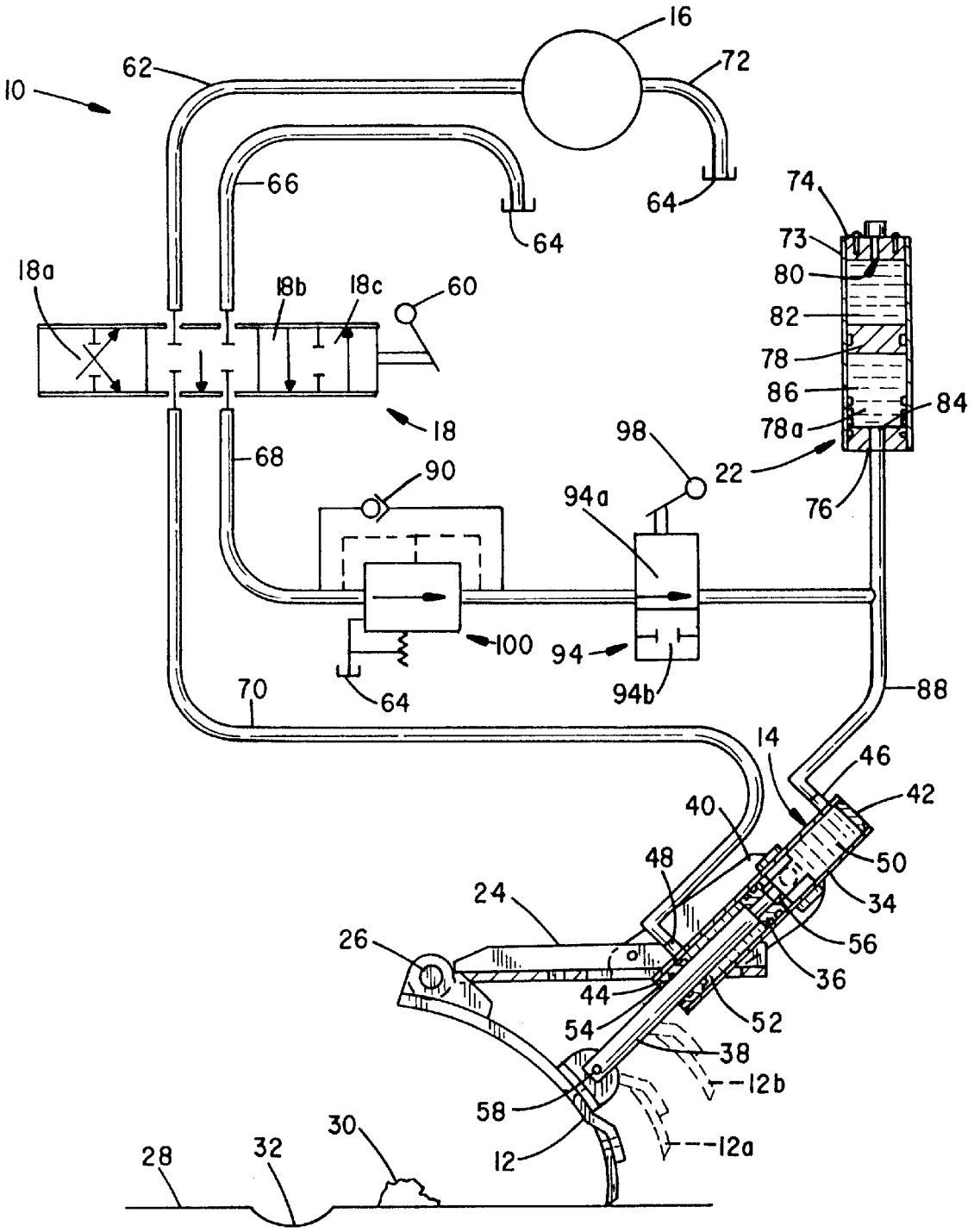
FIG. 3 is a schematic diagram of a third preferred embodiment of the improved plowing system of the present invention.

FIG. 3 illustrates the improved plowing system 10 constructed in accordance with yet a third preferred embodiment of the present invention. In this embodiment, a pressure reducing/relieving valve 100 has been substituted for the pressure relief valve 92 set forth in FIG. 2 and a one-way check valve 90 has been included as set forth in FIG. 1. Aside from these changes, all of the other components of the improved plowing system 10 shown in FIG. 3 are identical to those in FIGS. 1 and 2 and, as a result, a repeat discussion of these components is deemed unnecessary. Suffice it to say that the pressure reducing/relieving valve 100 operates in substantially the same fashion as the pressure relief valve 92 discussed above with reference to FIG. 2 such that the pressure reducing/relieving valve 100 cooperates with the shut-off valve 94 to collectively perform in the same fashion as the pressure reducing valve 20 set forth in FIG. 1. The pressure reducing/relieving valve 100 restricts the inflow of pressurized hydraulic fluid into the biasing circuit (conduit 88, first actuating chamber 50, second accumulator chamber 86) until a predetermined biasing pressure is developed therewithin. However, as with the pressure relief valve 92 of FIG. 2, the pressure reducing/relieving valve 100 is configured to re-route hydraulic fluid back into the fluid reservoir 64 when overpressure conditions develop above and beyond the predetermined hydraulic biasing pressure. Once again, the shut-off valve 94 is provided to overcome this overpressure re-routing function of the pressure reducing/relieving valve 100 such that the hydraulic fluid may be locked within the biasing circuit once the predetermined hydraulic biasing pressure is obtained.

Figure 4:
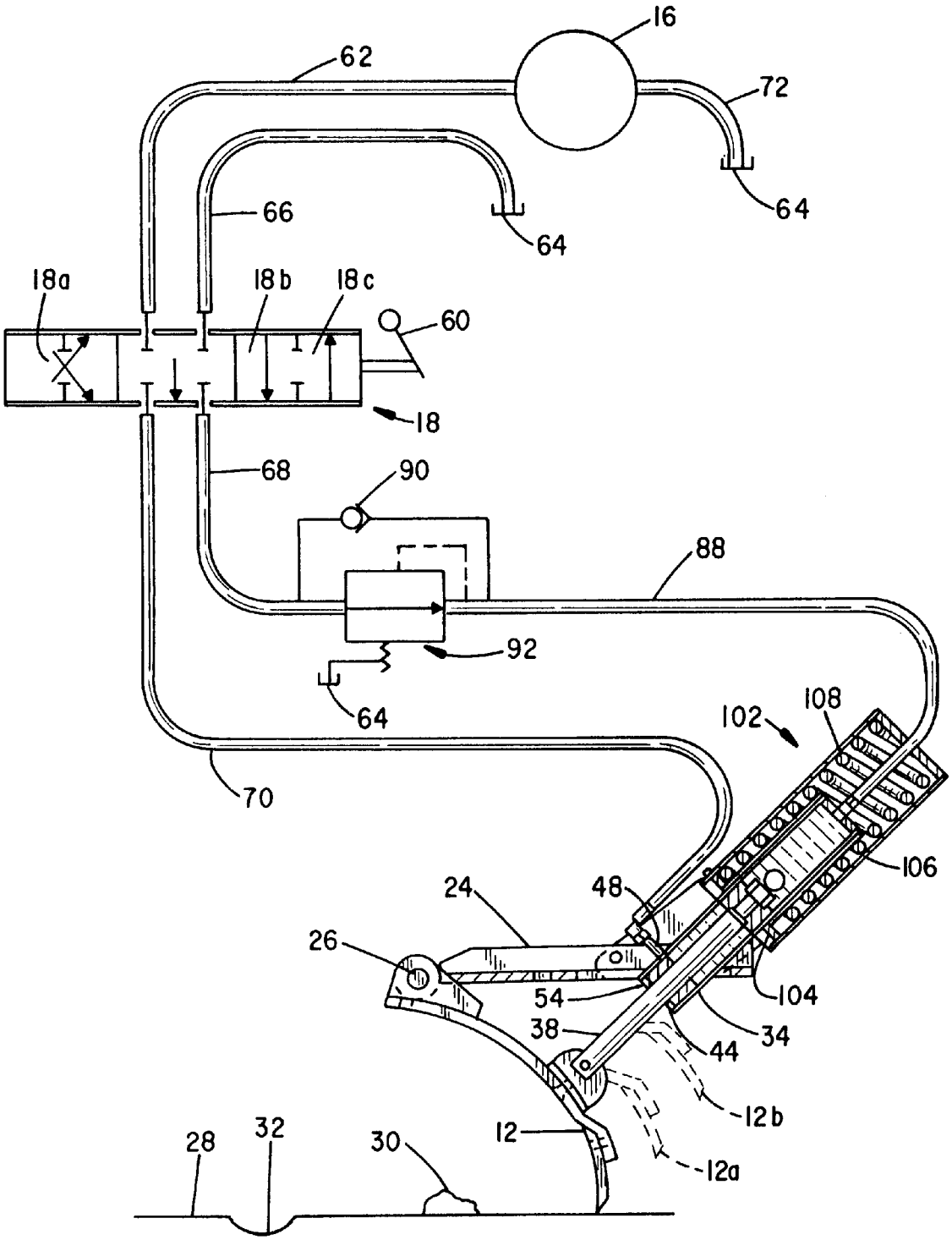
FIG. 4 is a schematic diagram of a fourth preferred embodiment of the improved plowing system of the present invention.

FIG. 4 illustrates the improved plowing system 10 constructed in accordance with a fourth preferred embodiment of the present invention. In this embodiment, the improved plowing system 10 is identical to the embodiment shown in FIG. 1 with the exception of a spring-loaded cylinder 102 which is substituted for the accumulator 22 of FIG. 1. The spring-loaded cylinder 102 includes a spring support ring 104 rigidly attached to the exterior of the housing member 34 of the actuating cylinder 14, a spring retaining cylinder 106 rigidly coupled to the motor vehicle (not shown), and a compression spring 108 disposed within the retaining cylinder 106 and extending between one end of the retaining cylinder 106 and the spring support ring 104. In order to retractably bias the scraper 12 against the road surface 28, the control valve 18 must first be set to the scraper-lowering mode 18*a*. In this position, the spring 108 initially forces the scraper 12 into contact with the road surface 28 as shown, after which point the inward flow of pressurized hydraulic fluid into the first actuating chamber 50 progresses until the hydraulic pressure within the biasing circuit (the conduit 88 and the first actuating chamber 50) exceeds the spring constant. As the hydraulic pressure within the biasing circuit progressively increases, the housing member 34 of the actuating cylinder 14 is forced back into the retaining cylinder 106 such that the spring 108 compresses therewithin. In an important aspect of the present invention, the pressure reducing valve 20 limits the inflow of hydraulic fluid into the biasing circuit until a predetermined hydraulic biasing pressure of approximately 500 p.s.i. is developed therewithin. The spring constant of the spring 108 should be advantageously chosen such that the spring 108 will only be partially compressed within the retaining cylinder 106 when the predetermined hydraulic biasing pressure is attained within the biasing circuit. In this fashion, the spring 108 within the cylinder 106 is capable of absorbing overpressure conditions which develop within the biasing circuit when the scraper 12 encounters immovable obstructions while disposed in the road-contacting position. As with the embodiments shown in FIGS. 1–3, this serves the same function as the accumulator 22 to allow the scraper 12 to temporarily yield to such obstructions and thereafter return to a fully engaged position at the predetermined downforce to continue scraping operations.

In light of the foregoing, the present invention solves the various drawbacks found in the prior art. To be more specific, the improved plowing system of the present invention resiliently biases the plow against the road surface so as to readily accommodate dips or depressions in the road, while at the same time allowing the plow to quickly and retractably yield to obstacles in the road surface without the need recharge the system once the obstruction has been passed. The improved plowing system is also advantageous in that eliminates the need to recharge and recalibrate the hydraulic pressure within the system each time plowing operations are initiated, thereby decreasing the time required to prepare the truck for operation and decreasing the likelihood of cylinder damage. In an important aspect of the present invention, the improved plowing system also eliminates the potential for diesel combustion present in prior art plowing systems. The improved plowing system also allows the scraper 12 to yield upon hitting an obstacle without presenting the possibility that unwanted debris will prohibit the scraper 12 from returning to the proper position against the road surface 28.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself It is furthermore noted that the corresponding structures, materials, acts, and equivalents of all means or step plus function elements are intended to include any structure, material, or acts for performing the functions in combination with other claimed elements as specifically claimed.

For example, it is to be readily understood that the manual shut-off valve 94 shown in FIGS. 2 and 3 may be provided as any number of commercially available automatic shut-off valves which automatically close off the biasing circuit (the conduit 88, the first actuating chamber 50, and the second accumulator chamber 86) after a predetermined pressure has accrued therewithin. By way of example and not limitation, this may be achieved by providing an automatic shut-off valve in a feedback arrangement with a pressure sensing element within the biasing circuit.

It is furthermore to be fully appreciated that the fundamental features from the foregoing embodiments may be selectively interchanged without departing from the scope of the present invention. For example, it is filly anticipated that the shut-off valve 94 along with the pressure relief valve 92 and/or the pressure reducing/relieving valve 100 may be substituted for the pressure reducing valve 20 shown in FIG. 4 without varying from the scope of the present invention.

What is claimed is:

1. A plow blade operating system comprising:

(a) scraper blade means hingedly coupled to a motor vehicle; a double-acting actuating cylinder having a generally cylindrical housing member coupled to said motor vehicle, a slidable piston member disposed within said cylindrical housing member defining a first actuating chamber and a second actuating chamber, and an elongated rod member extending between said piston member and said scraper blade means;

(b) control means coupled to said actuating cylinder for selectively maneuvering said scraper blade means into a retractably engaged position against a road surface, said control means including fluid delivery means, pressure modulation means, and overpressure absorption means;

(c) wherein said fluid delivery means is communicatively coupled to said pressure modulation means for selectively delivering hydraulic fluid under pressure to said pressure modulation means;

(d) wherein said pressure modulation means is communicatively coupled to said first actuating chamber and with said overpressure absorption means for charging said first actuating chamber to a predetermined biasing pressure such that said piston member forces said scraper blade means against said road surface at a predetermined downforce;

(e) wherein said overpressure absorption means includes an accumulator means, said accumulator means including a generally cylindrical housing member, a floating piston member slideably disposed within said housing member, said piston member defining a first accumulator chamber and a second accumulator chamber, said first accumulator chamber being pre-charged with a predetermined quantity of gas and said second accumulator chamber being disposed in fluid communication with said first actuating chamber of said actuating cylinder such that said piston member of said accumulator means compresses said gas to a predetermined gas pressure when said predetermined biasing pressure is attained within said first actuating chamber, said accumulator means being capable of temporarily absorbing overpressure conditions within said first actuating chamber due to said means momentarily retracting from said road surface upon encountering an obstacle and thereafter returning said scraper blade means to said road surface when said obstacle has been passed; and (f) wherein said pressure modulation means is further characterized as preventing the loss of hydraulic fluid within a biasing circuit during said overpressure conditions, said biasing circuit including said first actuating chamber and a conduit member extending between said first actuating chamber and said pressure modulation means.

2. The plow blade operating system of claim 1 wherein said pressure modulation means further includes a pressure reducing valve for preventing said hydraulic fluid within said first actuating chamber and said conduit member from escaping when said scraper blade means encounters obstacles while in said engaged position.

3. The plow blade operating system of claim 1 wherein said pressure modulation means includes a pressure relief valve and a selectively operable shut-off valve, said pressure relief valve having an inlet coupled to said fluid delivery means and an outlet coupled to said shut-off valve, said shut-off valve being communicatively coupled to said first actuating chamber via said conduit member for selectively prohibiting the escape of hydraulic fluid from within said biasing circuit when said scraper blade means encounters obstacles while disposed in said engaged position.

4. The plow blade operating system of claim 3 wherein said shut-off valve is capable of automatically closing when said hydraulic fluid within said first actuating chamber reaches said predetermined biasing pressure.

5. The plow blade operating system of claim 1 wherein said pressure modulation means includes a combination pressure relief/pressure reducing valve and a selectively operable shut-off valve, said combination pressure relief/pressure reducing valve having an inlet coupled to said fluid delivery means and an outlet coupled to said shut-off valve, said shut-off valve being communicatively coupled to said first actuating chamber via said conduit member for prohibiting the escape of hydraulic fluid from within said biasing circuit when said plow means encounters obstacles while disposed in said engaged position.

6. The plow blade operating system of claim 5 wherein said shut-off valve is capable of automatically closing when said hydraulic fluid within said first actuating chamber reaches said predetermined biasing pressure.

7. The plow blade operating system of claim 1 wherein said gas is nitrogen.

8. A plow blade operating system comprising:

(a) plow means hingedly coupled to a motor vehicle; a double-acting actuating cylinder having a generally cylindrical housing member coupled to said motor vehicle, a slidable piston member disposed within said cylindrical housing member defining a first actuating chamber and a second actuating chamber, and an elongated rod member extending between said piston member and said plow means;

(b) control means coupled to said actuating cylinder for selectively maneuvering said plow means into a retractably engaged position against a road surface, said control means including fluid delivery means, pressure modulation means, and overpressure absorption means;

(c) wherein said fluid delivery means is communicatively coupled to said pressure modulation means for selectively delivering hydraulic fluid under pressure to said pressure modulation means;

(d) wherein said pressure modulation means is communicatively coupled to said first actuating chamber and cooperatively operable with said overpressure absorption means for charging said first actuating chamber to a predetermined biasing pressure such that said piston member forces said plow means against said road surface at a predetermined downforce;

(e) said overpressure absorption means comprises a spring assembly having a generally cylindrical spring member, a spring retaining cylinder fixedly attached to said motor vehicle, and spring support means coupled to said housing member of said actuating means, said spring member extending between a first end of said spring retaining cylinder and said spring support means for absorbing overpressure conditions within said first actuating chamber of said actuating cylinder when said plow means encounters an obstacle while disposed in said engaged position against said road surface; and (f) wherein said pressure modulation means is further characterized as preventing the loss of hydraulic fluid within a biasing circuit during said overpressure conditions, said biasing circuit including said first actuating chamber and a conduit member extending between said first actuating chamber and said pressure modulation means.

9. The plow blade operating system of claim 8 wherein said fluid delivery means includes hydraulic pumping means for pumping hydraulic fluid under pressure from a fluid reservoir to control valve means, said control valve means being configured to selectively direct said hydraulic fluid under pressure to said pressure modulation means.

10. An apparatus for biasing a vehicle-mounted plow against a road surface at a predetermined bias level such that said plow can retractably overcome obstacles encountered while plowing and thereafter return to said predetermined bias level against said road surface, said apparatus comprising:

(a) actuating means coupled between said vehicle and said plow for selectively positioning said plow relative to said road surface, said actuating means including a housing member, a piston member dimensioned to be slideable within said housing member to define a first actuating chamber and a second actuating chamber, and an elongated rigid member extending between said piston member and said plow;

(b) means for controlling said actuating means including fluid delivery means for delivering hydraulic fluid under pressure, pressure modulation means communicatively coupled to said hydraulic fluid delivery means, and overpressure absorption means coupled to said actuating means;

(c) whereby said pressure modulation means is cooperatively operable with said overpressure absorption means to generate a predetermined hydraulic biasing pressure within a biasing circuit comprising said first actuating chamber and a conduit member extending between said first actuating chamber and said pressure modulation means to thereby retractably bias said plow against said road surface at said predetermined bias level, said overpressure absorption means is capable of temporarily absorbing overpressure conditions within said biasing circuit due to said plow hitting an obstacle while plowing, and said pressure modulation means is capable of preventing the escape of hydraulic fluid from within said biasing circuit during said overpressure conditions; and (d) wherein said overpressure absorption means is selected from the group consisting of:

(1) accumulator means having a housing member and a piston member slideably disposed within said housing member so as to define a first accumulator chamber and a second accumulator chamber, wherein said first accumulator chamber is precharged with a predetermined quantity of gas and said second accumulator chamber communicatively coupled to said first actuating chamber such that said piston member of said accumulator means compresses said gas to a predetermined gas pressure when said predetermined biasing pressure is attained within said first actuating chamber; and (2) a spring assembly having a generally cylindrical spring member, a spring retaining cylinder fixedly attached to said motor vehicle and spring support means coupled to said housing member of said actuating means, said spring member extending between a first end of said spring retaining cylinder and said spring support means for absorbing overpressure conditions within said first actuating chamber of said actuating cylinder when said plow is displaced due to encountering an obstacle while plowing.

11. The apparatus of claim 10 wherein said pressure modulation means includes a pressure reducing valve for preventing said hydraulic fluid within said biasing circuit from escaping when said plow is displaced due to encountering obstacles while plowing.

12. The apparatus of claim 10 wherein said overpressure absorption means is an accumulator means.

13. The apparatus of claim 12 wherein said pressure modulation means including a pressure relief valve and a selectively operable shut-off valve, said pressure relief valve having an inlet coupled to said fluid delivery means and an outlet coupled to said shut-off valve, said shut-off valve being communicatively coupled to said first actuating chamber via said conduit member for prohibiting the escape of hydraulic fluid from within said biasing circuit when said plow is displaced due to encountering obstacles while plowing.

14. The apparatus of claim 13 wherein said shut-off valve means is capable of automatically closing when said hydraulic fluid within said first actuating chamber reaches said predetermined biasing pressure.

15. The apparatus of claim 12 wherein said pressure modulation means includes a combination pressure relief/pressure reducing valve and a selectively operable shut-off valve, said combination pressure relief/pressure reducing valve having an inlet coupled to said fluid delivery means and an outlet coupled to said shut-off valve, said shut-off valve being communicatively coupled to said first actuating chamber via said conduit member for selectively prohibiting the escape of hydraulic fluid from within said biasing circuit when said plow is displaced due to encountering obstacles while plowing.

16. The apparatus of claim 15 wherein said shut-off valve is capable of automatically closing when said hydraulic fluid within said first actuating chamber reaches said predetermined biasing pressure.

17. The apparatus of claim 12 wherein said gas is nitrogen.

* * * * *